United States Patent [19]

Kasten

[11] Patent Number: 5,001,795

[45] Date of Patent: Mar. 26, 1991

[54] BEDSPREAD RACK

[76] Inventor: Walter Kasten, 5080 N. Ocean Dr., 15 C, Singer Island, Fla. 33404

[21] Appl. No.: 485,352

[22] Filed: Feb. 26, 1990

[51] Int. Cl.[5] ..... A47C 21/00

[52] U.S. Cl. ..... 5/504; 256/65; 403/347; 211/195

[58] Field of Search ..... 5/426, 504, 506, 507; 211/175, 182, 195; 403/347; 256/65, 66

[56] References Cited

U.S. PATENT DOCUMENTS

| | | | |
|---|---|---|---|
| 2,562,333 | 7/1951 | Bies . | |
| 2,614,827 | 10/1952 | Peach et al. | 256/65 X |
| 2,976,546 | 3/1961 | Owens . | |
| 2,979,736 | 4/1961 | Kemman . | |
| 3,241,159 | 3/1966 | Reed . | |
| 3,290,701 | 12/1966 | Luff | 5/426 |
| 3,435,469 | 4/1969 | Fricke . | |
| 3,822,053 | 7/1974 | Daily | 256/65 X |
| 3,885,256 | 5/1975 | Du Boff . | |
| 4,461,461 | 7/1984 | Caron | 256/65 X |
| 4,466,600 | 8/1984 | Tuttle | 256/65 |
| 4,841,589 | 6/1989 | Moore | 5/504 |

FOREIGN PATENT DOCUMENTS

| | | | |
|---|---|---|---|
| 502107 | 11/1954 | Italy . | |
| 1084019 | 9/1967 | United Kingdom | 5/504 |
| 1238500 | 10/1969 | United Kingdom . | |

*Primary Examiner*—Michael F. Trettel

*Attorney, Agent, or Firm*—Gifford, Groh, Sprinkle, Patmore & Anderson

[57] ABSTRACT

A bedspread rack having a portion which is to be located between the bed spring and mattress and which is retractable from a use position for supporting a bedspread or blanket to a storage position in between the mattress and spring. The entire structure is constructed from PVC tubing so that it can be packaged in a tubular bundle and easily assembled without nuts, bolts, screws or other fasteners. The resulting rack is lightweight and inexpensive.

9 Claims, 1 Drawing Sheet

BEDSPREAD RACK

BACKGROUND OF THE INVENTION

1. Field of the Invention

This invention relates to a bedding storage device, and, more particularly, it relates to a bedspread or blanket rack which is located at the foot or bottom end of a bed.

2. Description of the Prior Art

There are a wide variety of bedspread and blanket holders or racks available. Many of these racks are free standing and are merely placed at the bottom end of the bed to support the bedspread and possibly a blanket. Some of the racks or holders have parallel prongs or fingers which extend between the mattress and springs to aid in the support of the rack. In some of the racks having prongs, the prongs are continued in a horizontal plane to provide the support surface for the bedspread. This latter design allows the user to push the prongs further between the mattress and spring when not in use. However, such retracting use causes scuffing and wear and tear on the mattress and spring coverings and may require considerable push to locate the rack in its storage position.

An improvement in the horizontal prong rack has been the provision of retraction or storage tubes assembled in a frame structure and supported between the mattress and springs. The prongs fit in the tubes thus reducing the sliding force required to move the rack between the storage and use positions. This also eliminates the frictional wear and tear on the spring and mattress covers. However, even with this sliding improvement, the rack or holder remains a cumbersome piece of furniture with the prongs being solid rods which are welded or otherwise permanently attached to a cross member and the retraction and storage tubes also being similarly joined or attached to a cross structure.

SUMMARY OF THE INVENTION

The present invention is directed to improvements in a retractable type of bedspread rack. The present improvements provide a much lighter weight and less expensive rack which can be packaged in a tubular bundle form for further cost savings. Assembly of the rack by the user is simple requiring no tools or fastening structures such as screws, bolts, nuts, washers or other devices.

In one embodiment the extensible or retractable bedspread rack includes four or five separate support tubes each having an aperture or hole tranversely through the tube close to one end of the tube. A crossbar is inserted through the apertures as they are aligned so that the support tubes are positioned in a spaced parallel relationship to each other. The means for holding the support tubes positioned on the crossbar is preferably a releasable holding means in the form of a frictional fit between the support tube apertures and the crossbar. Separate storage tubes for each of the support tubes receive the other end of the support tubes so that the storage tubes can be placed extending in the direction of the bed length located between the box spring and mattress of the bed.

The support tubes are slidable in the storage tubes and movement between a storage position in which the support tubes are substantially completely within the storage tubes to a use position in which the crossbar and support tubes extend a substantial distance from the bottom end of the bed is obtained by grasping the crossbar. The crossbar can also be a tube, and all of the storage, support and crossbar tubes preferrably are manufactured with polyvinyl chloride, PVC, tubing to provide a light weight, strong and inexpensive structure.

The crossbar tube can be provided with a longitudinal slot so that it can be squeezed to pass through the apertures and flex outwardly to provide a frictional fit for releasably holding the support tubes positioned relative to the crossbar tube. To further reduce the overall packaging and shipping size, the crossbar tube can be made up of two or more sections which telescope together.

Preferably, cooperating stops are provided on the support tubes and storage tubes to prevent the support tubes from being removed completely from the storage tubes as the support tubes are being slidably extended from their storage position to the use position.

In another embodiment, the crossbar can be provided with a number of spaced holes or apertures into which the ends of the support tubes are pushed to position the support tubes in a spaced parallel relationship to each other. In this embodiment the simplest method of holding the support tubes positioned on the crossbar is by the use of a PVC cement; however, releasable holding means can also be provided. As with the first embodiment, the crossbar can be a tube. The apertures can pass through one side of the tube so that the end of the support tube can be shaped to abut against the inside wall of the crossbar tube. Alternatively, the apertures can pass transversely through the crossbar tube so that the ends of the support tubes extend through the crossbar tube.

It will be readily apparent that in the drawing and description to follow that other advantages are provided by the improved structure and that further variations can be made.

BRIEF DESCRIPTION OF THE DRAWING

The preferred embodiments of the invention are illustrated in the drawing in which.

DETAILED DESCRIPTION OF THE PRESENTLY PREFERRED EMBODIMENTS OF THE INVENTION

Figure 1:
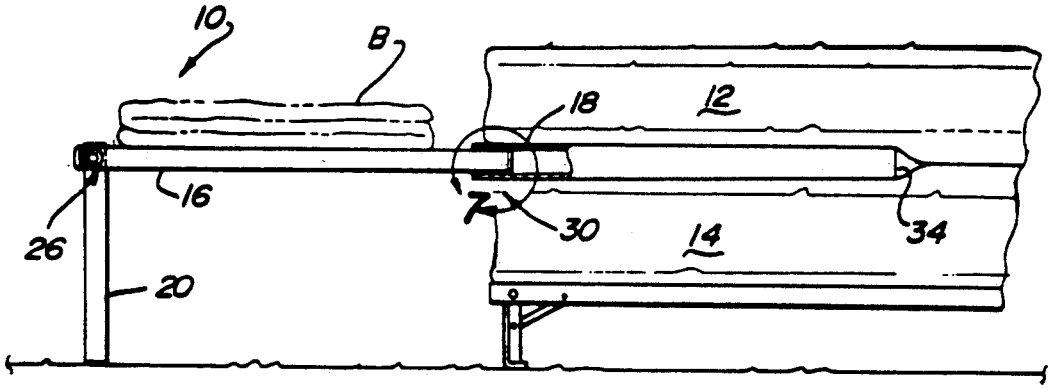
FIG. 1 is a partial side view showing the rack of this invention installed between a box spring and mattress with the rack being extended into its use position with a support leg.

Referring to FIG. 1, the bedsrpead rack 10 of this invention is shown supported between mattress 12 and box spring 14. The rack 10 is shown in it use position with the support tubes 16 fully extended from storage tubes 18 and with the forward end of the rack 10 being supported by at least one leg 20. Bedspread B is shown stored on the surface provided by support tubes 16.

Preferably the entire rack is made with light weight plastic tubing. Polyvinyl chloride, PVC, tubing is available in a large variety of sizes and thicknesses for plumbing applications and the like. I have found, for example, that thin wall PVC irrigation pipe is ideal and inexpensive while providing a very strong and light weight structure. I have also found that split PVC rigid tubing similar to that used around guy wires of utility poles is very satisfactory.

Figure 2:
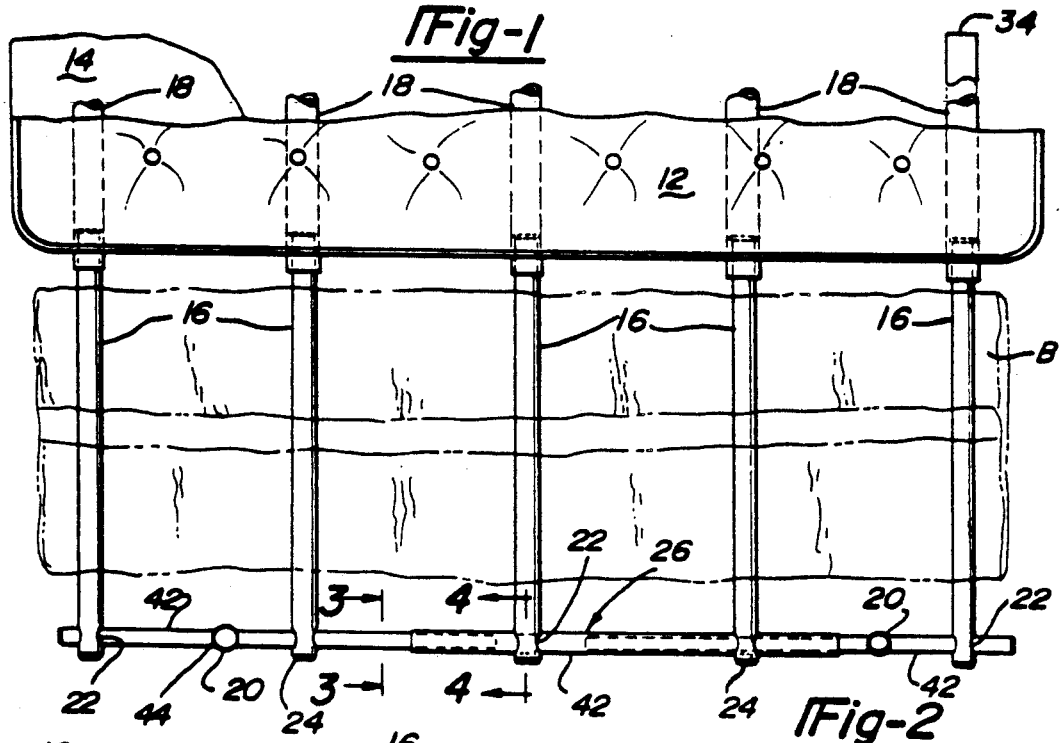
FIG. 2 is a plan view partially in section showing the rack of this invention in its extended use position.
Figure 7:
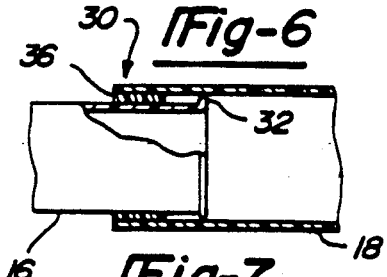
FIG. 7 is a cross sectional view showing a stop arrangement.

Referring to FIG. 2, with a queen or king size bed normally four or five support tubes 16 are used to span the width of the bed and support a bedspread of like width. As shown in FIG, 4, each of the support tubes 16 has a hole or aperture 22 through the tube adjacent to its foward end 24. Apertures 22 are aligned, and crossbar 26 is passed through the apertures to position the support tubes 16 in a parallel spaced arrangement. Support tubes 16 are held in position by a frictional fit of crossbar 26 in support tube apertures 22. Storage tubes 18 are provided for each support tube 16. The support tubes 16 are slidable within the storage tubes 18 so that the rack 10 can be pulled into its open use position as show in FIGS. 1 and 2 by grasping crossbar 26. Similarly, the rack 10 can be slid into its storage position by pushing on crossbar 26 so that the support tubes 16 are within the storage tubes 18 with crossbar 26 in close proximity to the ends 28 of the storage tubes 18. As seen in FIG. 7*a* stop 30 is provided for each coupled storage tube 18 and support tube 16 to prevent the complete removal of the support tubes from the storage tubes. This can take the form of a collar or sleeve 32 cemented to the outside of each support tube 16 adjacent to its end 34 and a collar 36 cemented to the inside diameter of each storage tube 18 adjacent its end. With this stop arrangement the forward end 24 of each support tube 16 is inserted into a rearward end 38 of each storage tube 18, and the support tubes 16 are pulled forward prior to insertion of crossbar 26 into the support tube apertures 22. The storage tubes 18 can be packaged with the support tubes 16 so inserted.

Figure 3:
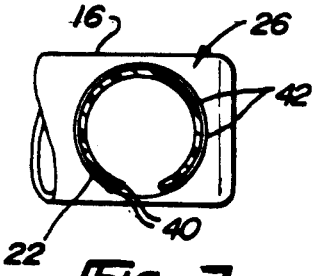
FIG. 3 is a cross section taken along line 3—3 of FIG. 2 showing one embodiment of the crossbar.
Figure 4:
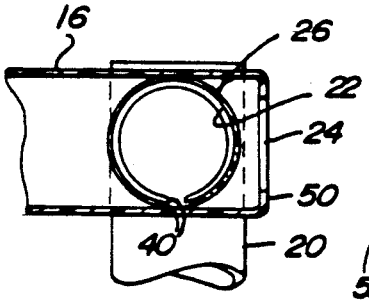
FIG. 4 is a cross section taken along line 4—4 in FIG. 2.

The crossbar 26 can take the form of a tube as shown in FIGS. 3 and 4, and the tube can have a longitudinal slot 40 so that the crossbar 26 can be squeezed for easy insertion into apertures 22. After insertion, the tube will then flex outwardly to provide a frictional fit for releasably holding the support tubes 16 on the crossbar tube 26.

In order to minimize the package length of the unassembled rack 10, the crossbar 26 can be made of two or more sections 42 which can be telescoped together in assembly as shown by the three sections 42 of crossbar tube 26 in FIG. 2. The support legs 20 are assembled to the crossbar 26 as it is being slid through the apertures 22 either as a single tube or in the multiple sections 42 with the crossbar passing through apertures 44 at the top end of the legs 20. Two support legs 20 are shown between adjacent support tubes 16 in FIG. 2.

Figure 5:
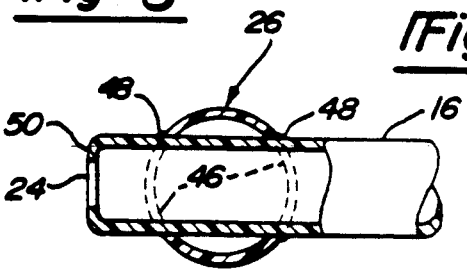
FIG. 5 is a cross sectional view similar to FIG. 4 showing an alternate embodiment in which the assembling apertures are located in the crossbar tube.

In the embodiment shown in FIG. 5, the support tube apertures 22 have been eliminated and spaced apertures 46 have been provided for &n crossbar tube 26. The rack 10 is assembled by inserting the end 24 of each support tube 16 through an aperture 46 in crossbar tube 26 and applying PVC cement at 48 as shown in FIG. 5. The exposed ends of the support tubes 16 can be flared as shown at 50 to eliminate sharp edges in both the embodiments of FIG. 4 and 5.

Figure 6:
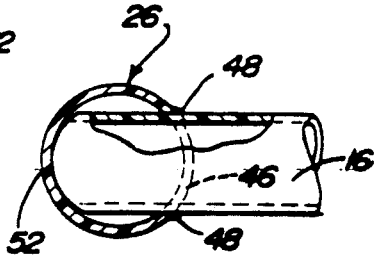
FIG. 6 is a cross sectional view similar to FIGS. 4 and 5 showing a further variation of the embodiment of FIG. 5.

In the embodiments of FIG. 6, the crossbar tube 26 has the spaced apertures 46 passing through only one side of the tube 26. The ends of the support tubes 16 are shaped at 52 so as to abut against the inside wall of crossbar tube 26.

Typically, the overall width of the bedspread supporting surface provided by the support tubes and cross bar will be about four feet with a width of a little less than two feet using 22" long support tubes and storage tubes, with support tubes and legs having a 13/16" outside diameter and the storage tubes having a 1 1/16' outside diameter.

The embodiments of the invention in which an exclusive property or privilege is claimed are defined as follows:

1. An extensible bedspread rack comprising:

a plurality of separate support tubes each having a transverse aperture through the tube adjacent one end thereof;

a crossbar passing through said apertures as they are aligned to receive said crossbar, said support tubes being positioned in spaced parallel relationship to each other;

means releasably holding said support tubes positioned on said crossbar; and a plurality of storage tubes, one for each of said support tubes, receiving the other ends of said support tubes, so that said storage tubes can be placed extending in the direction of the bed length located between the box spring and mattress of said bed, said support tubes being slidable in said storage tubes by grasping said crossbar and moving said crossbar and support tubes from a storage position, where the support tubes are substantially completely within the storage tubes, to a use position, in which said crossbar and support tubes extend a substantial distance from the bottom end of the bed.

2. The rack according to claim 1 wherein said means for releasably holding said support tubes positioned on said crossbar includes a frictional fit.

3. The rack according to claim 2 wherein said crossbar is a tube.

4. The rack according to claim 3 wherein said crossbar tube is a resilient plastic having a longitudinal slot so that it can be squeezed to pass through said apertures and flex outwardly to provide a frictional fit for releasably holding said support tubes positioned.

5. The rack according to claim 4 wherein said crossbar tube is formed in a plurality longitudinally extending sections telescoped together.

6. The rack according to claim 3 wherein said storage, support and crossbar tubes are all PVC.

7. The rack according to claim 1 further including a support leg having an aperture at one end to receive said crossbar between two adjacent support tubes.

8. The rack according to claim 1 including four support tubes and four storage tubes.

9. The rack according to claim 1 including cooperating stops on said support tubes and storage tubes to prevent the support tubes from being removed completely from said storage tubes as said support tubes are being slidably extended from said storage position to said use position.

* * * * *